US006997030B1

(12) United States Patent
Williams

(10) Patent No.: US 6,997,030 B1
(45) Date of Patent: Feb. 14, 2006

(54) REBAR BENDING TOOL

(76) Inventor: Jason Brian Williams, 12695 S. Oak Ave., Floral City, FL (US) 34436

( * ) Notice: Subject to any disclaimer, the term of this patent is extended or adjusted under 35 U.S.C. 154(b) by 0 days.

(21) Appl. No.: 11/036,405

(22) Filed: Jan. 14, 2005

(51) Int. Cl.
*B31J 13/08* (2006.01)
*B21D 9/05* (2006.01)

(52) U.S. Cl. ..... 72/458; 72/218; 72/388; 72/31.04

(58) Field of Classification Search ..... 72/458, 72/479, 37, 31.04, 388, 387, 217; 140/123
See application file for complete search history.

(56) References Cited

U.S. PATENT DOCUMENTS 2,675,723 A * 4/1954 Stein ..... 72/458
2,857,792 A * 10/1958 Mcnish ..... 72/458
3,732,721 A * 5/1973 Cusimano ..... 72/458
D365,260 S 12/1995 Austinson
5,669,258 A * 9/1997 Luebke ..... 72/31.04
5,816,095 A * 10/1998 Nordell, II et al. ..... 72/458
5,901,600 A * 5/1999 Decker ..... 72/388
D416,566 S 11/1999 Perez
6,418,773 B1 * 7/2002 Tolman ..... 72/458

* cited by examiner

*Primary Examiner*—David Jones
(74) *Attorney, Agent, or Firm*—Frank B. Arenas

(57) ABSTRACT

A bending tool is disclosed for bending rebar, rod, pipe, tubing and/or any other suitable material, comprising: at least one base, and; at least one lever-handle further comprising a user-end and a pivot-end and; a pivotal means for connecting the base and the pivot-end of the lever-handle with rotational freedom, and; a means for bending disposed on the pivot-end of the lever-handle. Optionally, a pre-measure base and protractor or angle indicator may be also used. The lever-handle may be removed and used independently as a pry-bar to reposition protruding rebar from hardened concrete in the wrong location and for other prying-type uses.

5 Claims, 5 Drawing Sheets

REBAR BENDING TOOL

BACKGROUND OF THE INVENTION

1. Field of the Invention

The present invention relates generally to concrete reinforcement bar bending tools, though it may be used for any other appropriate type rod, pipe, tube or malleable material bending. The invention particularly relates to bending rebars, as they are commonly referred to in concrete industry. The invention more particularly relates to a device that easily bends rebars of all common sizes in the trade quickly and precisely using less human effort than conventional techniques.

2. Description of the Related Art

The reinforced concrete industry has evolved over the years from the early 1900s. Initially, human brute force by hand and feet was used to bend the steel rods to be used in poured concrete. The state of the art gradually improved to metal pegs on a wood base used to bend the rebars around the pegs or inserting the rebar into two pipe sections and bending the pipes at the joint between the pipes.

U.S. Design Pat. No. D365,260 issued to Austinson, et al. discloses an ornamental design for bending rebar.

U.S. Design Pat. No. D416,566 issued to Perez discloses another ornamental design for bending rebar.

There is nothing in the prior art, however, that quickly, efficiently and precisely bends rebar (or other appropriate type rod, pipe, tube or malleable material) as does this new and useful invention.

SUMMARY OF THE INVENTION

It is an object of this invention to bend appropriate and common sizes and types of rebar, rod, pipe, tubing or malleable material quickly and efficiently.

It is another object of this invention to allow precise bends of the above-mentioned materials at 90 degrees, 45 degrees or any other desired angle, including reverse angles.

It is a further object of this invention to optionally pre-measure the required length of material to be bent, if desired, prior to bending.

This new and useful bending tool accomplishes these objectives; the objects of this invention are achieved and the present invention provides a new and useful article of manufacture and method for use. The objects and advantages pertaining to the invention will become apparent in the following detailed description of the preferred embodiment.

DETAILED DESCRIPTION OF THE PREFERRED EMBODIMENT

Figure 1:
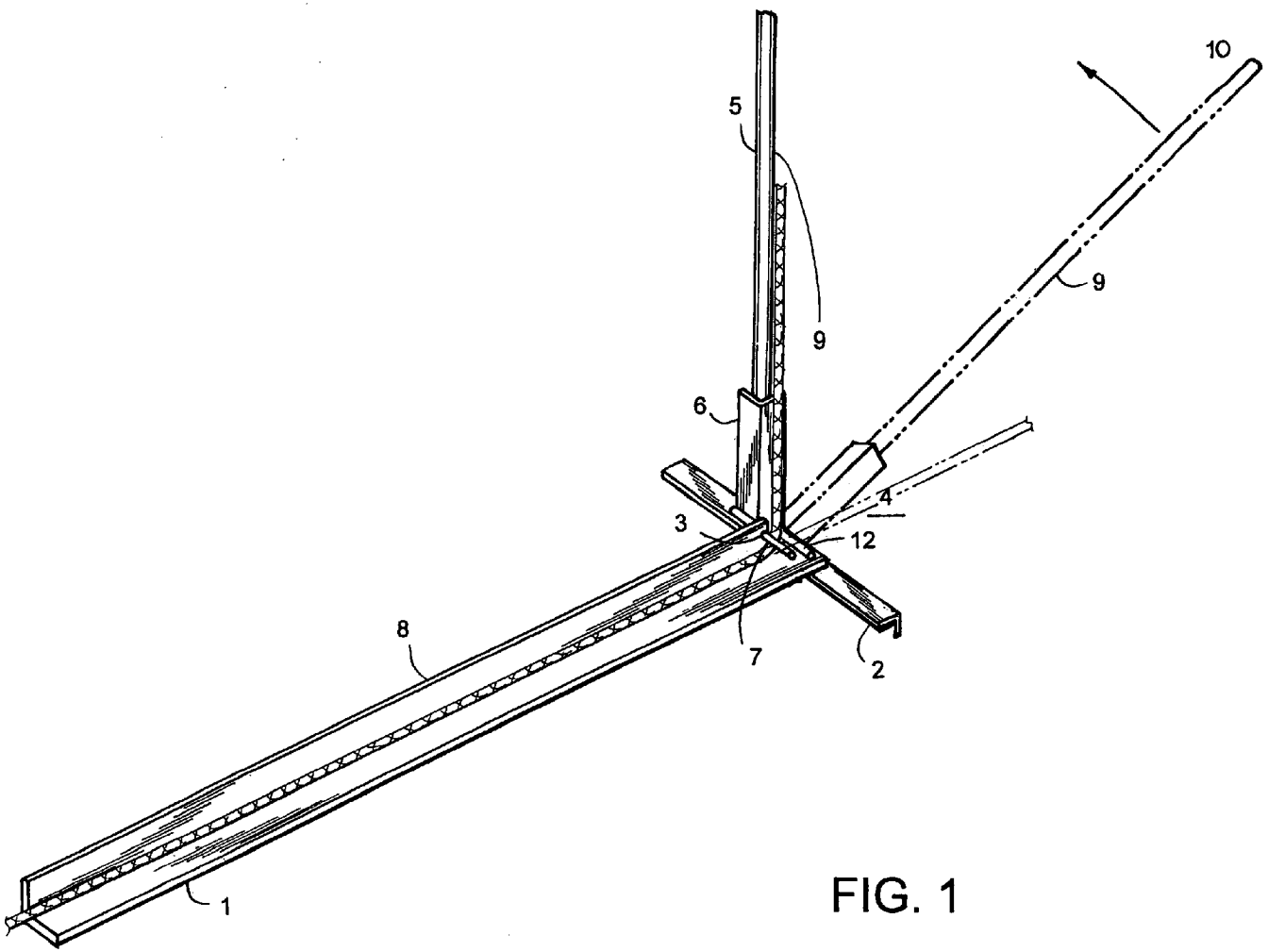
FIG. 1 depicts a perspective view of the device including the base and lever-handle in the open and bending positions, showing pre-bent rebar (in dashed lines) and post-bent rebar (solid lines).

The apparatus of the invention is conveniently fabricated by conventional and standard methods using conventional and standard materials common in the machining, tool manufacturing and metal fabrication industries.

For example, the bending tool device ("device") may be fabricated from steel, aluminum, stainless steel or like metals or any other suitable metal material. The device may also be fabricated from non-metallic materials for lighter weight corrosion resistance. Theses non-metallic materials include, among others, conventional polymers such as, for example, polystyrene, polycarbonate, polyurethane, polyethylene, phenol formaldehyde resins, polybutylene, Teflon and the like.

These above-mentioned materials are examples and do not limit the types of materials that can be used to make and use the device; any and all suitable materials may be used. The components of the device may be integrated together by standard means such as welding, bolting, gluing, riveting, fastening or any other suitable means. This invention is compact and of simple construction that is easy to make and use. In best mode, the device components attach together and apart for more compact storage and shipping.

The apparatus and method of using the invention will now be further described and exemplified by reference to the various specific embodiments set forth in the drawings. FIG. 1, FIG. 2, FIG. 3, FIG. 4, FIG. 5, FIG. 6 and FIG. 7 are views of the preferred embodiment and best mode of the invention (for illustration only, not intended to be limiting).

Again referring to all 7 Figures, the assembly and fabrication of the preferred embodiment of the invention will be described in detail. The device is assembled and fabricated from standard materials and methods now used in the appropriate industries.

Typically, the device comprises at least one base and at least one lever-handle (with a user-end and a pivot-end on the longitudinal axis of the lever-handle) connected with a means for pivoting with rotational freedom. The preferred embodiment further comprises at least one (optional) removable pre-measure frame. The pivoting means for connecting the lever-handle to the base of the device is typically at least one pivot-bending-pin integrated into the lever-handle and inserted through a hole in the base for rotational freedom. An optional protractor may be used to measure the bent angle.

The device may be adjustable or non-adjustable to vary the device's dimensions for different sized materials to be bent. The device is typically fabricated from steel, machined using conventional machine-shop and metal fabrication techniques such as drilling, cutting, smoothing, welding, bolting, polishing, sandblasting and painting. The device is shown with its design, functional aspects and relationship of components in scalable form in all of the drawings combined.

Now the method of making the device in the preferred embodiment and best mode will be described in detail. Referring to FIG. 1, first, suitable metal stock (typically 4"×4"×⅛"×4.5 feet long steel angle) is cut to the appropriate lengths for the longitudinal base piece 1 and lateral base piece 2 (typically 2"×2"×⅛"×2.5 feet long steel angle) and welded together perpendicular to each other to form the base 8. A hole 3 slightly larger than one inch diameter is drilled into the vertical leg on the steel angle near the far-end 4 of the longitudinal base piece 1 on top of and welded to the lateral base piece 2.

Figure 3:
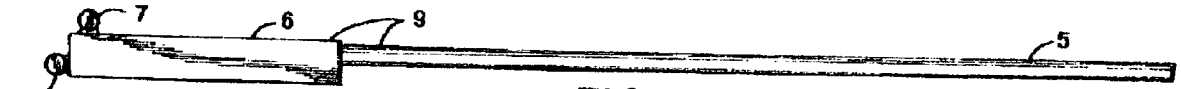
FIG. 3 depicts a side view of the lever-handle.
Figure 4:
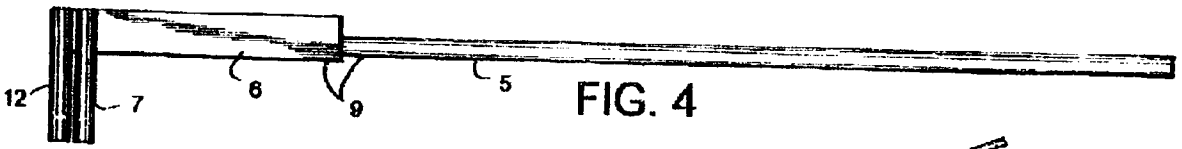
FIG. 4 depicts the top view of the lever-handle.

Referring now to FIGS. 3 and 4, the lever-handle 9 is fabricated typically using a solid steel round bar 1" in diameter and 3.5 feet long 5 welded to a (typically steel angle 2"×2"×⅛"×1 foot long) lever-handle reinforcement 6. At least one pivot-bending-pin 7 (typically solid steel round bar 1" in diameter and 4" long) and at least one static-bending-pin 12 (typically solid steel round bar 1" in diameter and 4" long) are welded perpendicular to the longitudinal axis of the lever-handle reinforcement 6 on the pivot-end of the lever-handle. The pivot-bending-pin 7 of the lever-handle 9 is inserted into the hole 3 of the base 8 and the device is ready to be used.

To use the device, the lever-handle 9 is opened out horizontally as shown in FIG. 1 (dashed lines). A piece of rebar (typically number 5 bars) of an appropriate length is inserted longitudinally along the longitudinal base piece 1 and between the two off-set bending pins (pivot-bending-pin 7 and static-bending-pin 12) to the desired length to be bent (as shown in the dashed lines). Then the operator grabs the user end 10 of the lever-handle 9 and pulls upwardly (in-line with the reference arrow on the drawing) with the required force to bend the rebar to the desired angle as shown in FIG. 1. Thus, the rebar is bent to the desired angle. Then, the lever-handle 9 is opened out horizontally as shown in FIG. 1 (dashed lines) and the rebar may be removed (or the rebar may be removed without opening out the lever-handle); the device is then ready to bend another piece of material i.e. rebar, rod, pipe or tubing.

Figure 2:
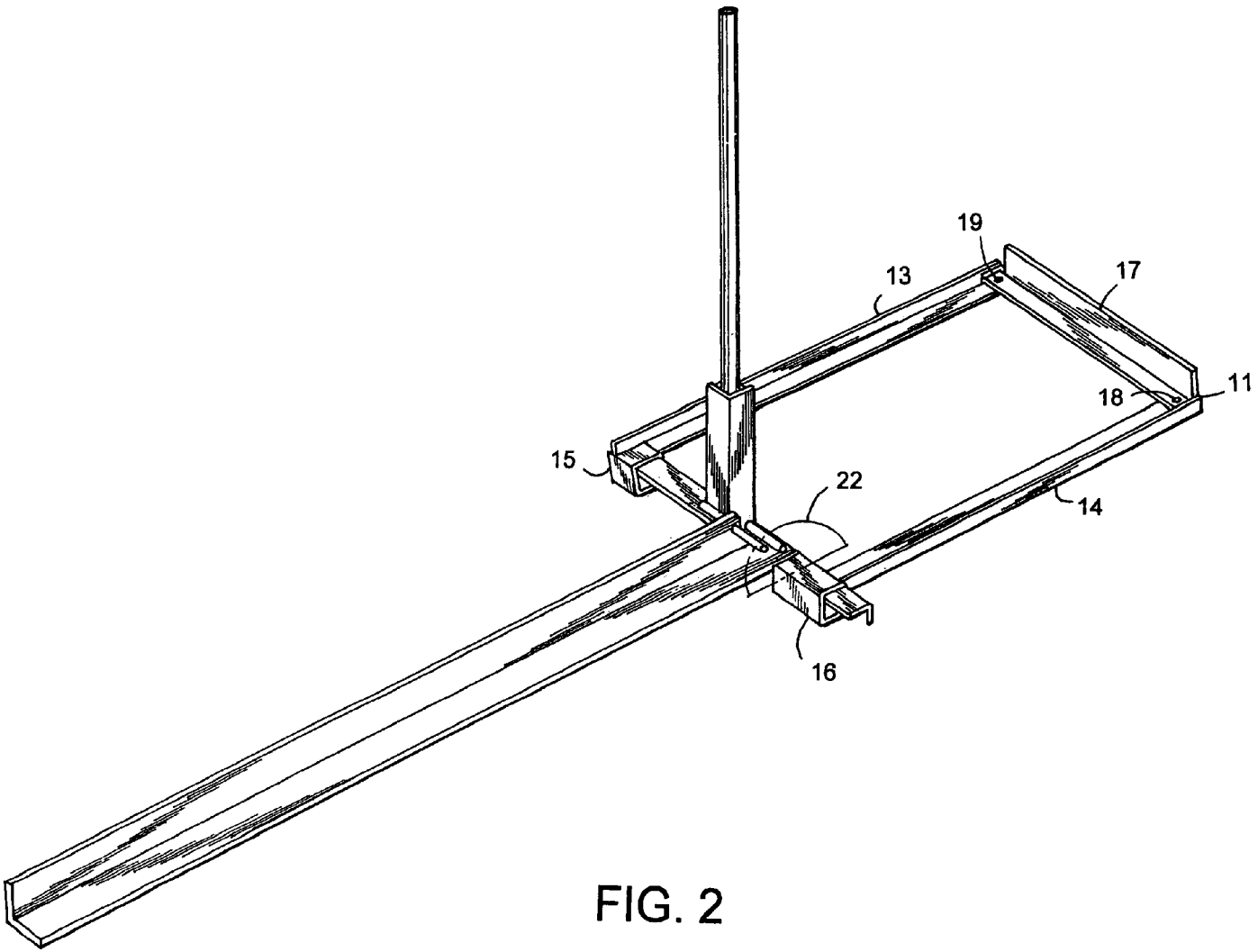
FIG. 2 depicts a perspective view of the device including the base (optional protractor in dashed lines), lever-handle and (optional) removable pre-measure frame attached in-line with the base.
Figure 6:
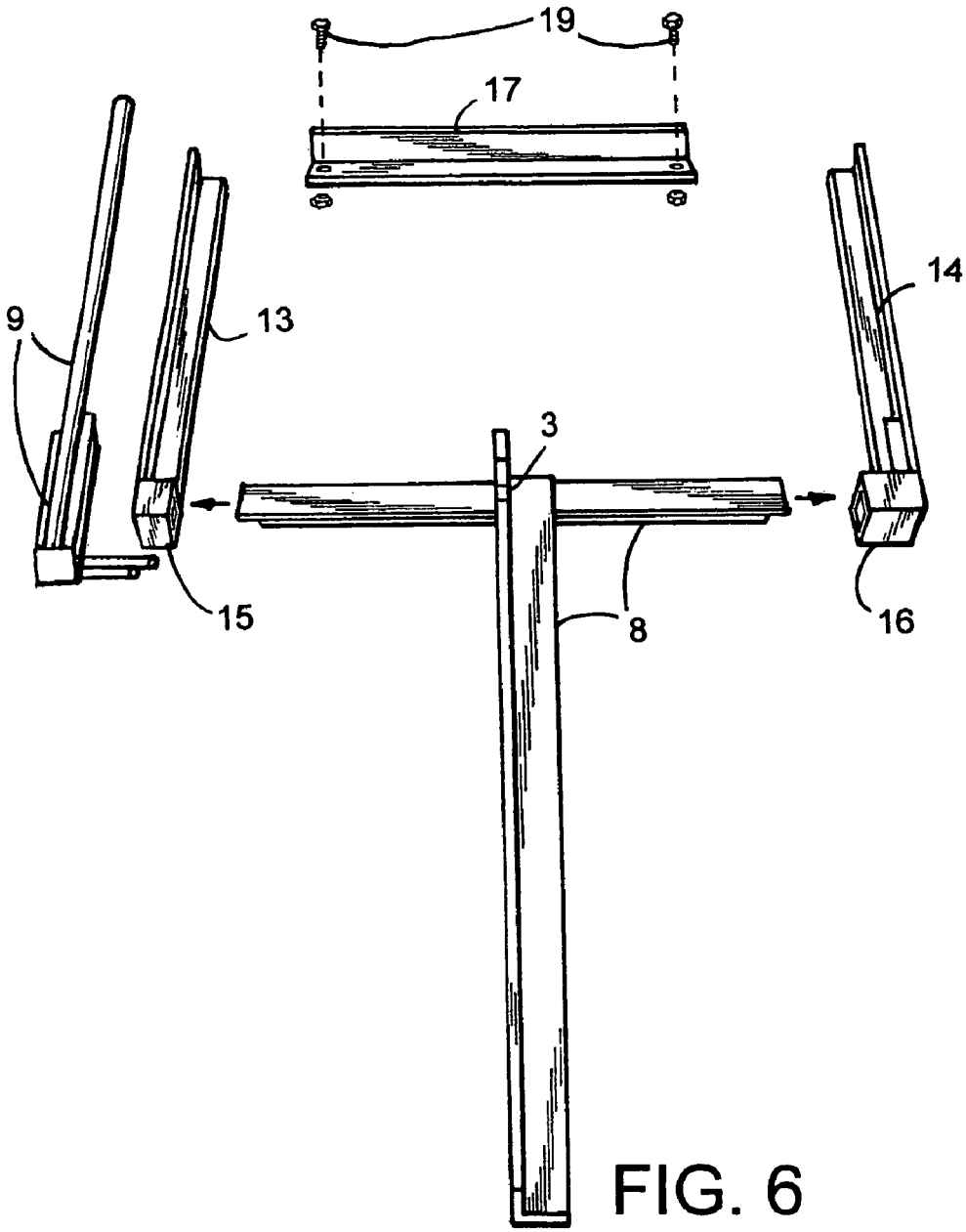
FIG. 6 depicts an exploded view of the elements of the device including the base (without optional protractor), lever-handle and (optional) removable pre-measure frame attached in-line with the base.
Figure 7:
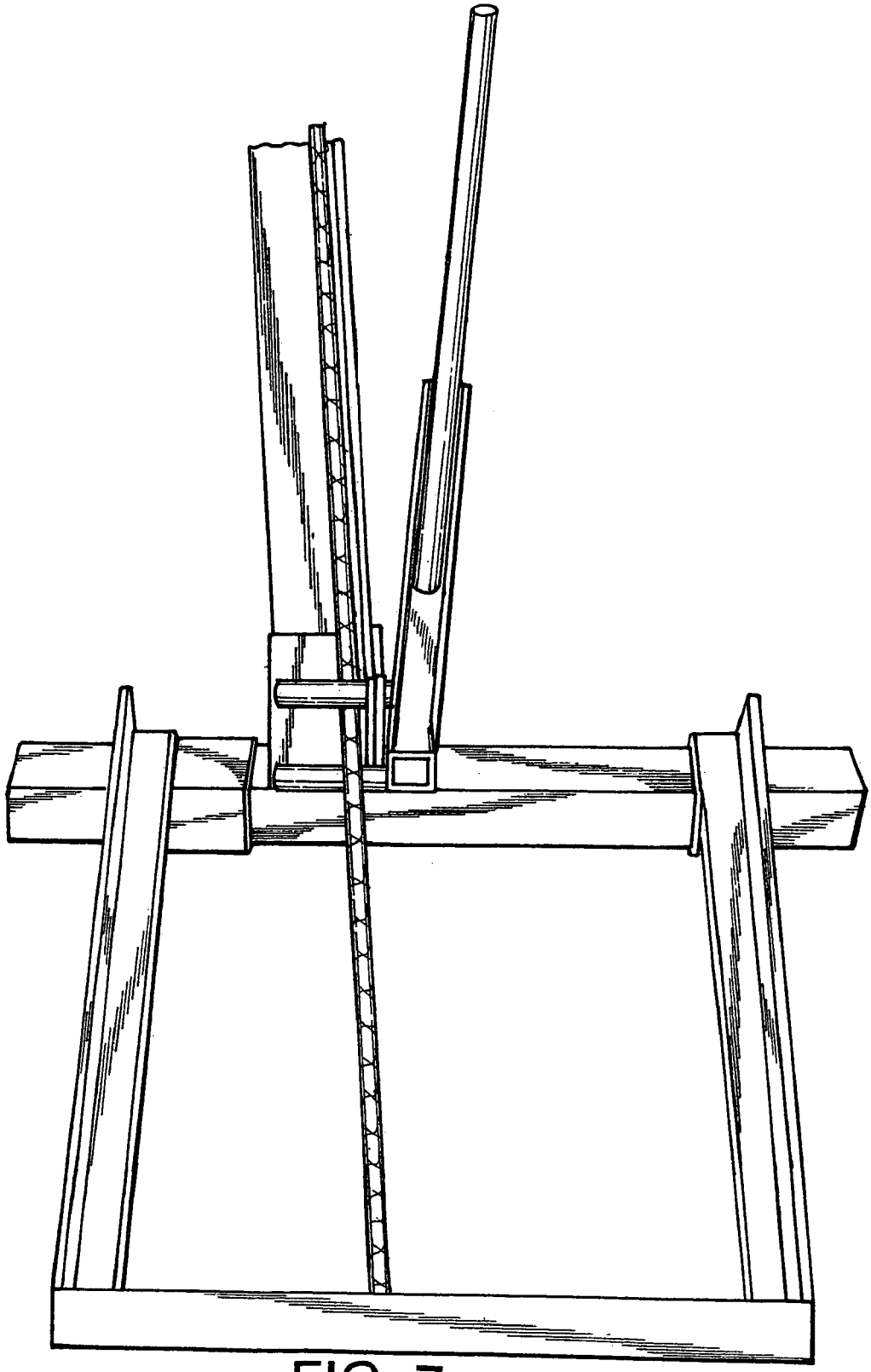
FIG. 7 depicts a perspective view of the device including the base (without optional protractor), lever-handle and (optional) removable pre-measure frame attached in-line with the base and piece of rebar inserted to pre-measured length, ready to be bent.

Optionally, a pre-measure frame 11 may be incorporated and used. Referring now to FIG. 2, FIG. 6 and FIG. 7, to make the pre-measure frame 11, typically steel angle 2"×2"×⅛"×2 feet long pieces are cut to form the left rail 13 and the right rail 14. Left frame-attach piece 15 and right frame-attach piece 16 are cut from square steel tubing with 2 and ⅛ inch inside dimensions and about 3" long and welded perpendicular to and at the ends of the left rail 13 and the right rail 14. A back-stop piece 17 is cut from steel angle (typically 3"×3"×⅛"×2 feet long) and holes 18 (typically slightly larger than ½ inch diameter) drilled both through the left rail 13, the right rail 14 and the back-stop piece 17 as shown in FIG. 2. Bolts and nuts 19 are inserted and tightened after the left frame-attach piece 15 and right frame-attach piece 16 are slid over the ends of the lateral base piece 2, making a rigid body of all welded and bolted pieces of pre-measure frame 11 in-line with the longitudinal base piece 1.

Referring now to FIG. 7, to use the pre-measure frame 11 in the preferred embodiment and best mode, it is attached by the operator to the base as described above. A piece of rebar (typically number 5 bars) of an appropriate length is inserted longitudinally along the longitudinal base piece 1 and between the two off-set bending pins (pivot-bending-pin 7 and static-bending-pin 12) to be in contact or nearly in contact with the back-stop piece 17. This automatically stops the bar at the desired length to be bent quickly and efficiently (in this instance about 2 feet); the left rail 13 and the right rail 14 may cut at any user-defined length i.e. 3 feet, 3.5 feet etc. and the pre-measure frame will automatically stop the rebar at said user-defined length. Or, the pre-measure frame may be made with optionally adjustable left and right rails to be adjusted to the desired length of bend.

Figure 5:
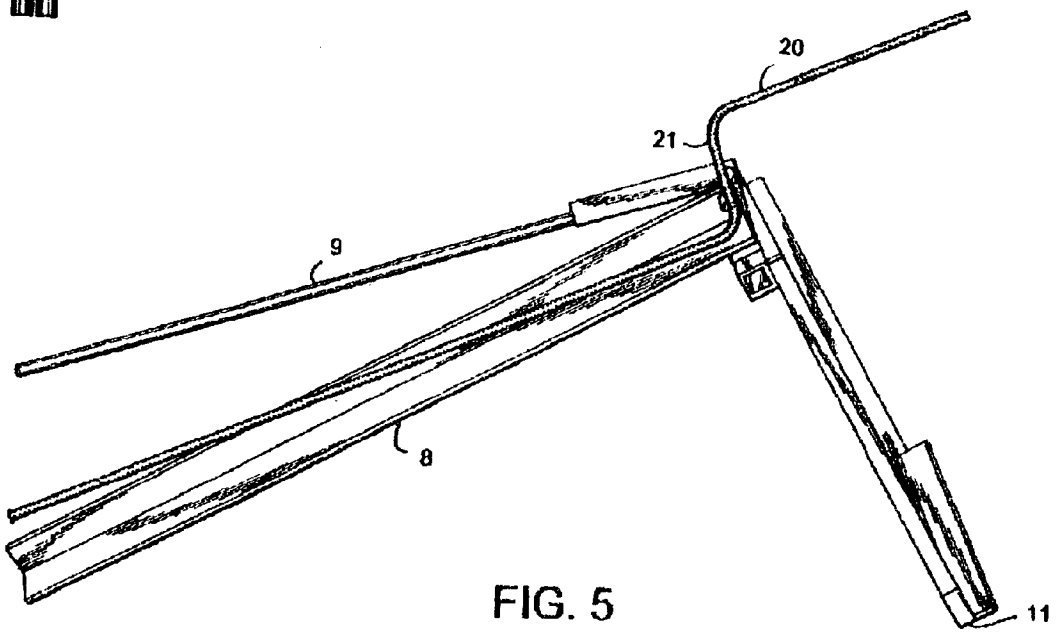
FIG. 5 depicts a perspective view of the device including the base, lever-handle and (optional) removable pre-measure frame attached at 90 degrees to the base for reverse bends.

For reverse bends, the bolts and nuts 19 are inserted and tightened after the left frame-attach piece 15 and right frame-attach piece 16 are slid over the ends of the lateral base piece 2, making a rigid body of all welded and bolted pieces of pre-measure frame 11 at a 90 degree angle to the longitudinal base piece 1 as shown in FIG. 5. This allows ground clearance as needed to allow room for a first-bent piece 20 (as described above) to then be bent a second time in the opposite direction 21. Optionally, a protractor 22 may be integrated at the pivot point to measure the angle while the rebar is being bent, as shown in dashed lines in FIG. 2.

Additionally (and optionally), the lever-handle 9 may be removed and used independently as a pry-bar to reposition protruding rebar from hardened concrete in the wrong location and for other prying-type uses.

As will be apparent to persons skilled in the art, such as designer, machinist or fabricator in the tool industry, various modifications and adaptations of the structure and method of use above-described will become readily apparent without departure from the spirit and scope of the invention, the scope of which is defined in the claims. Although the foregoing invention has been described in detail by way of illustration and example, it will be understood that the present invention is not limited to the particular description and specific embodiments described but may comprise any combination of the above elements and variations thereof, many of which will be obvious to those skilled in the art. Additionally, the acts and actions of fabricating, assembling, using, and maintaining the preferred embodiment of this invention is well known by those skilled in the art. Instead, the invention is limited and defined solely by the following claims.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein. Whenever and/or is used in the following claims, it means any combination or permutation of all, one, some, a plurality or none of the units of each item or list mentioned, which is not intended to be limiting but merely for example and illustration.

What is claimed is:

1. An apparatus for bending rebar, rod, pipe, tubing and/or any other suitable material, comprising:

at least one base, and;

at least one removable lever-handle further comprising a user-end and a pivot-end on the longitudinal axis of the removable lever-handle and;

a pivotal means for connecting the base and the pivot-end of the removable lever-handle with rotational freedom, and;

a means for bending disposed on the pivot-end of the removable lever-handle, and;

a removable means for pre-measuring attached in-line to the longitudinal axis of said base, which may be removed, rotated 90 degrees downwardly and re-attached perpendicular to said base, and;

a means for measuring angles disposed on the base or at the pivot-end of the removable lever-handle to measure the bend angle;

wherein when suitable material is inserted into the means for bending and a perpendicular force is applied by the operator to the user-end of the longitudinal axis of the removable lever-handle, the material is bent.

2. The apparatus of claim 1 wherein said pivotal means for connecting the base and the removable lever-handle with rotational freedom further comprises at least one pivot-bending-pin disposed onto said removable lever-handle and through at least one hole in said base.

3. The apparatus of claim 1 wherein the means for bending disposed on the pivotal-end of said removable lever-handle further comprises at least one static-bending-pin.

4. The apparatus of claim 1 wherein the removable means for pre-measuring further comprises a U-shaped frame.

5. The apparatus of claim 1 wherein the means for measuring angles further comprises a protractor that operates independently of gravity.

* * * * *